United States Patent [19]

Finnemore et al.

[11] Patent Number: 4,913,776

[45] Date of Patent: Apr. 3, 1990

[54] HIGH EFFICIENCY FOLDED PLATE HEAT EXCHANGER

[75] Inventors: Harlen E. Finnemore, Pocatelleo, Id.; Arthur A. Oare, Wellsville, N.Y.

[73] Assignee: The Air Preheater Company, Inc., Wellsville, N.Y.

[21] Appl. No.: 231,902

[22] Filed: Aug. 15, 1988

[51] Int. Cl.[4] ..... F28F 3/08

[52] U.S. Cl. ..... 165/166; 165/167

[58] Field of Search ..... 165/166, 167

[56] References Cited

U.S. PATENT DOCUMENTS

| | | | |
|---|---|---|---|
| 2,344,588 | 3/1944 | Blauvelt | 165/166 X |
| 2,400,617 | 5/1946 | Whellet | 165/166 X |
| 2,812,165 | 11/1957 | Hammond | 165/166 |
| 3,334,399 | 8/1967 | Teeguarden | 165/166 X |
| 4,116,271 | 9/1978 | De Le Peleire | 165/166 |

*Primary Examiner*—Martin P. Schwadron

*Assistant Examiner*—Allen J. Flanigan

*Attorney, Agent, or Firm*—Chilton, Alix & Van Kirk

[57] ABSTRACT

A packaged gas to gas heat exchanger is constructed by joining together a plurality of individual folded plate heat exchanger modules (16) in side by side and optionally end to end relation, without the need for an external housing surrounding the modules. A plurality of baffle plates (38), are prefabricated as part of each module, and joined to each other as the modules are joined, thereby defining a plurality of alternating chambers (46) for the entry or exit of different gases on either side of each folded plate (18). A closure arrangement and method for the longitudinal ends of the folded plates includes closure bars (94, 96) in interference engagement with the folds of the plate (18), and a separator plate (50) which holds the closure bars together and maintains the sealing relationship with the folded plate (18).

19 Claims, 7 Drawing Sheets

HIGH EFFICIENCY FOLDED PLATE HEAT EXCHANGER

BACKGROUND OF THE INVENTION

The present invention relates to heat exchangers, and more particularly to the type of heat exchanger in which two fluids at different temperatures are caused to flow on either side of a folded plate or sheet so that heat is transported through the folds from one fluid to the other.

British Patent Specification No. 320,279 discloses a folded plate heat exchanger applicable to the heat exchange between liquids and gases. The liquid and gas flow on respective sides of a single folded plate, which is enclosed within a housing which in turn is connected to a support surface. The proportion of the weight and materials associated with the housing and support results in a high materials and fabrication cost per unit of heat transfer capability. Moreover, this design is not easily adapted for utilizing a plurality of stacked or modular folded plates to realize greater efficiency and handle large volumes of gas to gas heat exchange.

U.S. Pat. No. 4,042,018 discloses a packaging system for gas to gas counter flow heat exchangers in which individual heat exchanger modules are located adjacent to each other within a housing. A plurality of plenum chambers are partially defined by suitably arranged baffles to direct the gas flow to the appropriate sides of the folded plates.

Although known heat exchanger packages of the type represented by the '018 patent operate effectively for their intended purpose, they are characterized by relative inefficiencies with respect to the amount, fabrication, and assembly of the materials and components utilized in manufacturing.

SUMMARY OF THE INVENTION

It is thus an object of the present invention to provide a packaged gas to gas heat exchanger in which the assembled package is constructed by joining together a plurality of individual folded plate heat exchange modules, without the need for an external housing surrounding the modules.

It is a further object to provided a baffle for each of the heat exchange modules, that is easily fabricated and joined to a respective module so as to cooperate with a complementary baffle of similar construction on an adjacent module, thereby defining a plurality of alternating chambers for the entry or exit of different gases on either side of each folded plate.

It is still another object to provide a simple yet reliable closure arrangement and method for the longitudinal ends of the folded plates, which not only serves as a seal between the different gases, but also affords a sufficient rigidity to support the baffles.

The folded plate heat exchanger module in accordance with the invention comprises a folded sheet of heat conductive material having opposed longitudinal edges and opposed side edges. The folds define on the front and back of the sheet, a plurality of parallel longitudinal ridges and parallel longitudinal channels between the ridges. A pair of flat, substantially rectangular flow plates are located on the front and back ridges, respectively, and have opposed side edges spanning the side edges of the folded sheet and have opposed longitudinal edges that are closer together than the longitudinal edges of the sheet, thereby exposing longitudinally upper and lower portions of the sheet. A pair of opposed side plates re sealingly attached at right angles to the side edges of the flow plates and longitudinally span the side edges of the sheet, the side plates having a depth in the front to back direction of the sheet which exceeds the distance between the flow plates so that each side plate projects a predetermined distance at least one flow plate. Each flow plate is sealingly attached at its side edges to a respective side plate and each folded sheet is sealingly attached along its side edges to at least one of a respective side plate and a respective flow plate. Structure is provided to sealingly engage one of the flow plates and the portions of the side plates projecting from the flow plates, thus blanking off the upper and lower exposed portions of the sheet from each other.

In accordance with the embodiment directed to the packaged folded plate heat exchanger unit, at least two modular heat exchangers are joined together in front-to-back relation, each heat exchanger module including a folded sheet of heat conductive material having opposed longitudinal edges and opposed side edges, the folds defining on the front and back of the sheet a plurality of parallel longitudinal ridges and parallel longitudinal channels between the ridges. A pair of flat, substantially rectangular flow plates are located on the front and back ridges, respectively, the flow plates having opposed side edges spanning the side edges of the folded sheet and having opposed longitudinal edges that are closer together than the longitudinal edges of the sheet, thereby exposing longitudinally upper and lower portions of the sheet. A pair of opposed side plates are sealingly attached at right angles to the side edges of the flow plates and longitudinally span the side edges of the sheet, the side plates having a depth in the front-to-back direction of the sheet which exceeds the distance between the flow plates so that each side plate projects a predetermined distance from the front flow plate. Each flow plate is sealingly attached at its side edges to a respective side plate, each folded sheet being sealingly attached along its side edges to at least one of a respective side plate and a respective flow plate. The front longitudinal edges of the side plates of the first module are joined to the back longitudinal edges of the side plates of the second module, thereby defining a three dimensional plenum space between the first and second modules. Structure sealingly engaging the front flow plate of the first module, the side plate projections, and the back flow plate of the second module, is provided for blanking off the upper exposed portions of the sheets from the lower exposed portions of the sheets on the first and second modules, thereby defining respective upper and lower flow plena between the first and second modules.

In another packaged folded heat exchanger unit embodiment, at least four modular heat exchangers are joined together in front-to-back relation, each heat exchanger including a folded sheet of heat conductive material having opposed longitudinal edges and opposed side edges, the folds defining on the front and back of the sheet a plurality of parallel longitudinal ridges and parallel longitudinal channels between the ridge. A pair of flat, substantially rectangular flow plates are located on the front and back ridges, of each sheet, and have opposed side edges spanning the side edges of each respective sheet and opposed longitudinal edges that are closer together than the longitudinal edges of each sheet, thereby exposing longitudinally upper and lower portions of the sheets. A pair of opposed side plates are sealingly attached at right angles to the side edges of each flow plate and longitudinally span the side edges of each sheet. Each flow plate is sealingly attached at its side edges to a respective side plate and each folded sheet being sealingly attached along its side edges to at least one of a respective side plate and a respective flow plate. A first plate sealingly engages the front flow plate of the first module and the back flow plate of the second module and a second plate sealingly engages the front flow plate of the second module and the back flow plate of a third module. A third plate sealingly engages the front flow plate of the third module and the back of the flow plate of the fourth module. First, second, and third upper plena and first, second, and third lower plena are thus defined between the front flow plate of the first module and the back flow plate of the second module, the front flow plate of the second module and the back flow plate of the third module, and the front flow plate of the third module and the back flow plate of the fourth module, respectively. Structure is provided for closing the longitudinal ends of the channels in each heat exchanger. First, second, and third upper baffle plates extend vertically from the respective means for closing the longitudinal ends of the channels of the first, second, and third sheets, each of the baffles being of modular construction and nested together front-to-back to define a plurality of independent flow distribution chambers. Each chamber is fluidly connected to a respective one of the plena.

A further embodiment of package heat exchanger unit in accordance with the invention has a gas flow distribution section fluidly connected to an active heat transfer section, the active section including a plurality of heat exchanger modules separated by a respective plurality and flow plena, the heat exchanger unit has top to bottom height, left to right width and front to back depth dimensions. The flow distribution section includes first and third unitary baffle plates, each including a wall portion substantially spanning the unit width dimension and having left and right side edges. At least one of the left and right side edges has a flap portion bent to form a sloped blocking plate projecting in the depth direction relative to the plate wall portion. The divider plate has a projecting edge parallel to the wall portion. The flow distribution section also has second and fourth unitary baffle plates, each including a wall portion substantially spanning the unit width dimension and having left and right side edges. At least one of the left and right side edges has a flap portion bent to form a sloped blocking plate projecting in the depth direction relative to the plate wall portion. The divider plate has a projecting edge parallel to the wall portion. The first, second, third, and fourth plates are nested sequentially in the depth dimension such that the projecting edges of each blocking plate establish line contact with a wall portion of an adjacent baffle plate, forming a seal therebetween. Thus, for each blocking plate, gas flow impinging on the top of the blocking plate is isolated relative to gas flow impinging on the bottom of the blocking plate.

In another embodiment, a set of modular baffle plates are defined for use in forming flow distribution chambers for a folded sheet packaged heat exchanger having a plurality of heat exchanger modules nested front-to-back on a uniform pitch. Each baffle plate comprises a planar wall portion with front and back surfaces and a straight horizontal base edge. Two opposed, side edges in the plane of the wall portion are angled toward each other symmetrically about an imaginary centerline projecting in the plane of the wall portion perpendicularly from the midpoint of the base edge. A flap portion is integrally formed along at least one of the side edges and angled relative to the plane, the juncture of the flap and wall portions forming a corner constituting one of the side edges. The flap portion projects from the planar wall a perpendicular distance substantially equal to the pitch and includes a projecting edge substantially parallel to the planar wall portion.

A method of embodiment for sealing the longitudinal end of a folded heat transfer sheet having front and back surfaces defined by a plurality of alternating convex and concave surfaces formed by alternating ridges and flow channels, is also disclosed and claimed. The method steps include selecting a first closure bar having a base portion and a plurality of flat, parallel, concave and convex contoured fingers projecting from the bar commensurate with the convex and concave surfaces of the front surface of the sheet. A second closure bar is selected having a base portion and a plurality of flat, parallel concave and convex contoured fingers projecting from the second bar commensurate with the convex and concave surfaces of the back surface of the sheet. The first closure bar is inserted perpendicularly to the ridges on the front surface of the sheet until the convex and concave projections mate with the concave and convex surfaces of the front sheet, respectively. The second closure bar is inserted perpendicularly to the ridges of the back surface of the sheet until the convex and concave projections mate with the concave and convex surfaces respectively, of the back side of the sheet. The closure bars are presses toward each other to form a tight interference engagement between the bar projections and the sheet front and back surfaces. The closure bar is then joined to a common support member whereby the tight interference engagement is permanently maintained.

BRIEF DESCRIPTION OF THE DRAWINGS

These other objects and advantages of the invention will become more evident from the following description and accompanying drawings, in which.

DESCRIPTION OF THE PREFERRED EMBODIMENT

Figure 1:
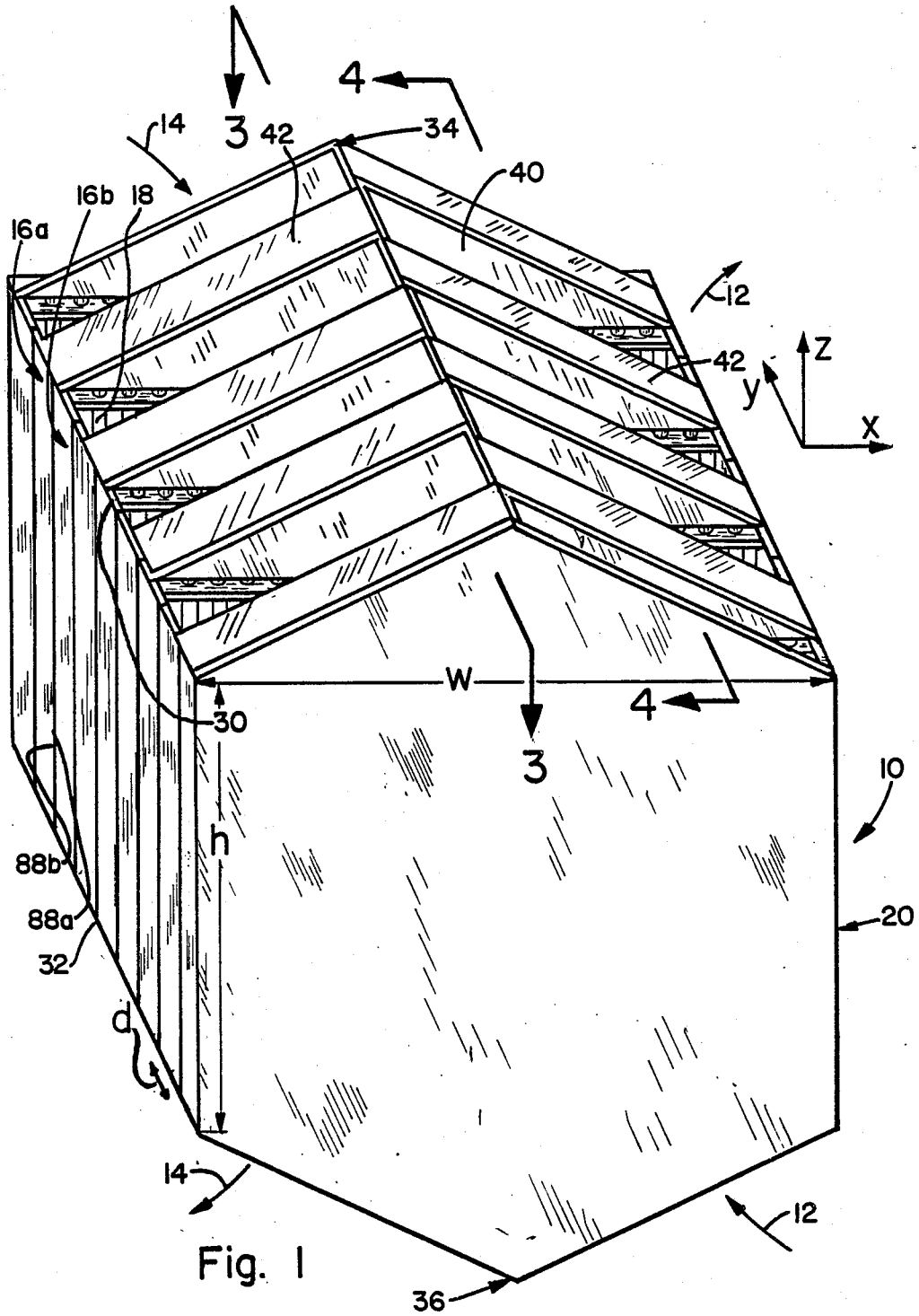
FIG. 1 is a perspective view of a vertically oriented folded plate packaged heat exchanger unit, in accordance with the invention.

FIG. 1 shows a vertically oriented, folded plate, packaged heat exchanger unit 10 incorporating a plurality of features of the present invention. For convenience in referring consistently to the various components and subcomponents to be explained more fully below, an arbitrary reference scheme is established in which the x, y, and z axes have the mutually perpendicular directionality shown in FIG. 1. Reference to width means in a direction along the x axis, reference to height is along the z axis, and reference to depth is along the y axis.

A heat exchanger of the general type shown in FIG. 1 is typically utilized for gas-to-gas heat exchange, and more particularly, for the transfer of heat from a hotter process gas to colder, ambient air. Although the composition of the gases in heat exchange relation may be the same or different, for convenience, reference hereinafter to air shall mean the colder gas, and reference to gas shall mean the hotter gas. Thus, in the packaged heat exchanger unit shown in FIG. 1, the gross operating characteristic of the heat exchanger is that a flow 12 of air enters the heat exchanger at the lower right and exits at the upper right, whereas the gas flow 14 enters at the upper left and exits at the lower left, the heat exchange thus occurring in counterflow across the heat transfer surfaces of the individual heat exchanger modules.

The upper region of the packaged heat exchanger as shown in FIG. 1 reveals the orientation of the individual heat exchanger modules 16 and their associated folded plates or sheets 18 In FIG. 1, and elsewhere, the heat exchanger modules 16 may be distinguished by numeric identifiers 16*a* and 16*b*, when differences relating to baffle structure at the upper and lower ends of the modules, is to be explained. The details of interest in the active section of the heat exchanger can be more easily understood with further reference to FIGS. 2–6. The active section 20 of the heat exchanger unit 10 contains a plurality of heat exchanger modules 16 having a height h substantially equal to the height of the active portion, a width w substantially equal to the unit width, and a depth d that is relatively small as compared with the height and width. Each heat exchanger module includes a heat transfer surface in the form of metal plate or sheet 18 folded to form alternating convex 22 and concave 24 surfaces which, in overall end view appearance, preferably define a sinusoid centered about a line extending in the width dimension of the module.

Each of the folded sheets 18 therefore includes a plurality of adjacent ridges 26 and channels 28 defined by the sinusoidal shape of the folded sheet, which ridges and channels extend the full height of the module 16 from the upper longitudinal end 30 to the lower longitudinal end 32. It is the overall function of the illustrated packaged heat exchanger 10 to achieve an upward flow 12 of air through half the channels 28 and a downward flow of gas through the other half of the channels 28, wherein each flow of air or gas is in heat exchange relation through the folded plate surface 18 with the flow of gas or air, respectively.

Figure 9:
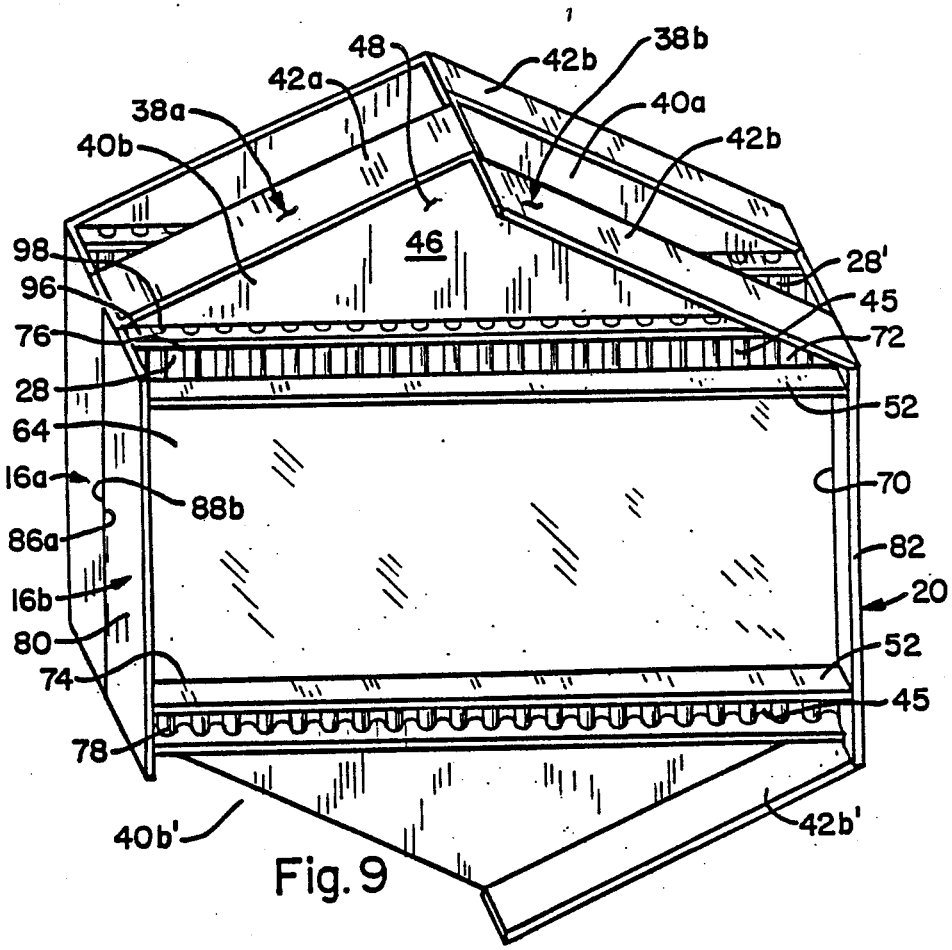
FIG. 9 is perspective view of the heat exchanger unit shown in FIG. 1 during assembly, in which the relationship of the baffle plates to the active section is shown.

At the upper 30 and lower ends 32 of the active portions of the unit 10, upper 34 and lower 36 distribution section are located, respectively. Each distribution section is formed by a plurality of interengaged baffle plates 38, which define openings 40 and blockages 42, to effect the desired separation and flow of the air and gas to and from respective air and gas channels 28 in the active section 20. For example, as shown in FIG. 9, for a given set of parallel flow channels 28 in a given heat exchanger module 16*b*, all gas enters the active section 20 by moving downwardly and to the left, either directly through the clear opening 40*b* at the left side of the baffle plate 38*b*, or by first impinging on the sloped flap portion 42*a* of adjacent baffle plate 38*a*, and then passing into opening 40*b*. The underside of flap 42*b* deflects some gas downwardly into the channels 28. Flap 42*b*, on module 16*b* deflects the gas flow emerging from the channels 28, downwardly and toward the left, where the gas exits the unit after giving up its heat to the air flowing upwardly in channels 28′ on the other side of the folded plate 18. This air emerges from channels 28′ and, with a portion deflected upwardly and to the right by the underside of flap 44*a*, exits the unit through opening 40*a*.

Figure 3:
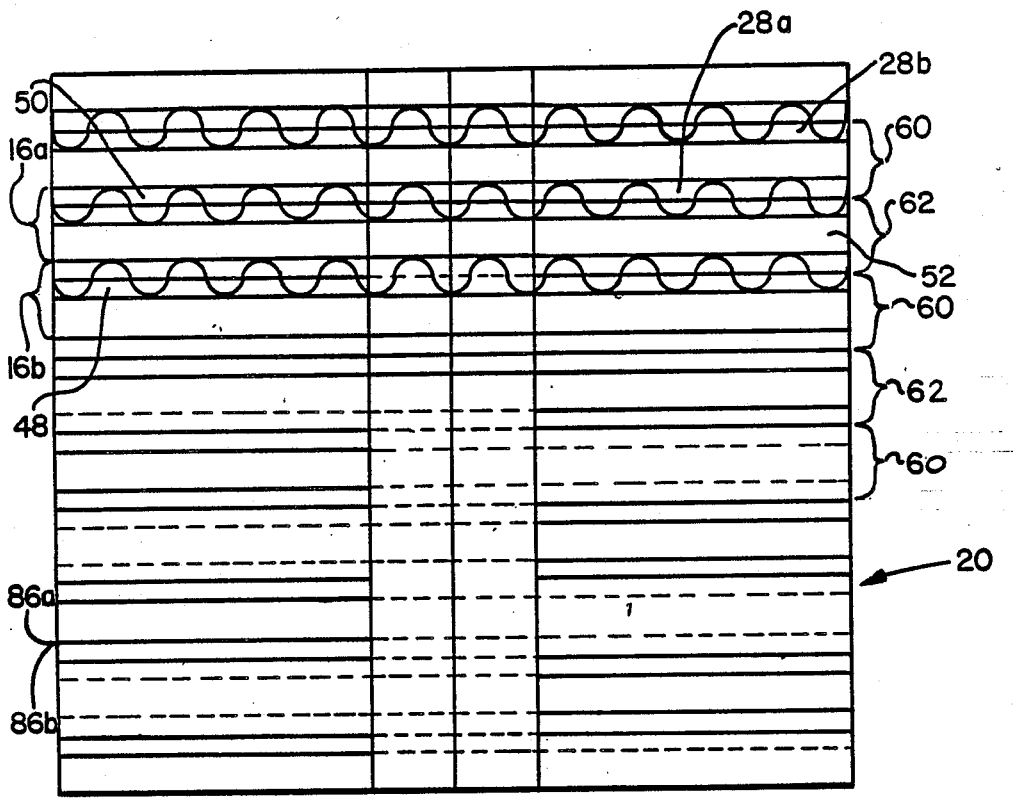
FIG. 3 is a sectioned top view of the heat exchanger unit, taken along line 3—3 of FIG. 1.
Figure 4:
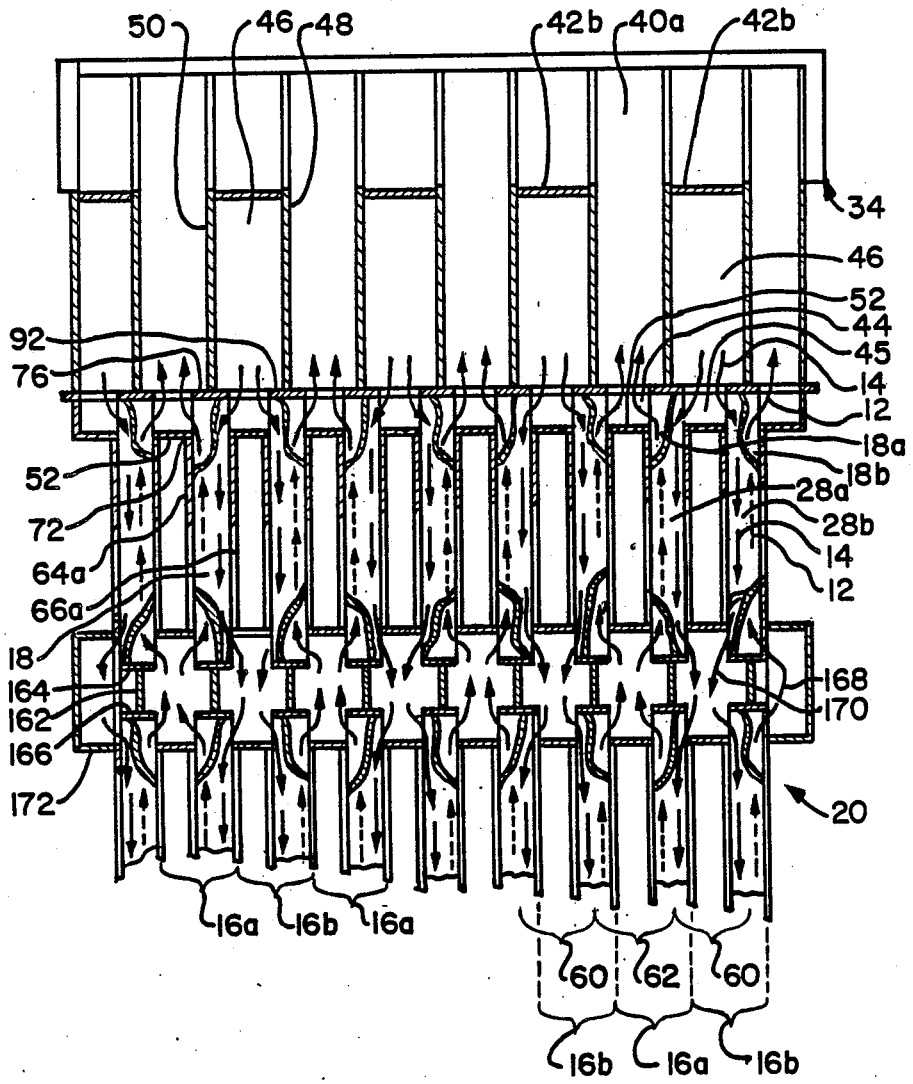
FIG. 4 is a sectioned side elevation view of the upper portion of the packaged heat exchanger unit, taken along line 4—4 of FIG. 1.

This is more evident from a close inspection of FIGS. 3 and 4 wherein it may be seen that a given stream of gas flow 14 that has been separated by the distribution section 34, is in fluid communication with the flow channels 28*a*, 28*b* of two adjacent heat exchanger modules 16*a*, 16*b*. A flow plenum 44 is provided between the flow channels of adjacent folded plates, and the individual distribution chambers 46 formed by the baffle plates of the distribution section, are fluidly connected to carrying the same flow gas 14.

In the flow distribution section, each distribution chamber 46 is defined by a pair of vertically oriented spaced apart planar wall portions 48, 50 of the baffle plates 38, running generally in the width dimension of the unit, and, when view from the front, have the appearance of isosceles triangles. The sloped portions of the baffle plate, in accordance with a feature of the invention, are folded over to form the blockage flaps 42 which separate and deflect different air and gas flows toward or from separate plena 44, 45, respectively. Blank off plates 52 between the folds of adjacent heat exchanger modules, in part define these plena. The air and gas plena 44, 45 alternate from front to back in the active section 20 of the unit. The openings 40 and sloped flaps 42 in the flow distribution section 34, alternate from front to back of the unit, and from left to right on either sloped edges of the triangular configurations of the baffle plate walls.

Figure 2:
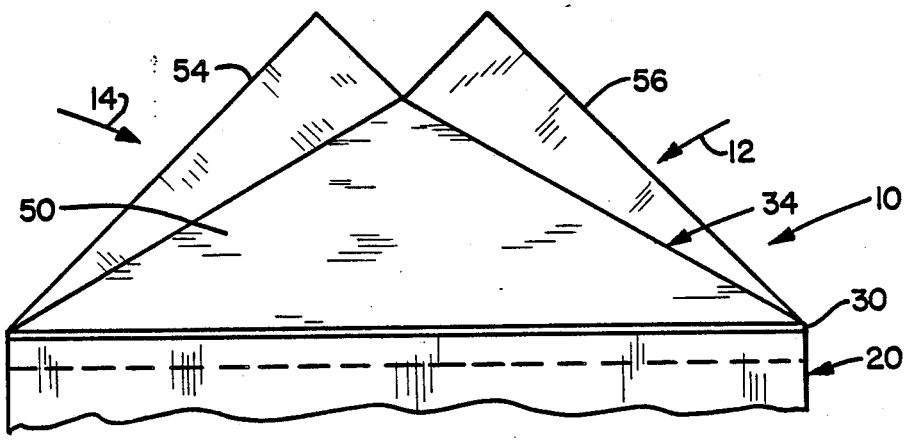
FIG. 2 is a front elevation view of the upper flow distribution section of the unit shown in FIG. 1, including inlet and outlet duct manifolds.

FIG. 2 shows that, when installed in the field, the distribution section 34 of the unit 10 is connected to manifold ducts 54, 56, which are adapted to mate with the rectangular perimeter of each of the sloped, upper extent of the left and right sides of the distribution section 34. The manifold ducts 54, 56 are not shown in FIG. 1 for clarity, but it should be appreciated that the duct 54, for example, would deliver a gas inlet supply to the upper left portion of the distribution section 34, and that this gas would enter the active section 20 either directly through the openings 40*b*, enter each of the chambers 46 and plena 45, for movement downward in channels 28*b* between the folds of the heat exchanger module. The flaps 42 prevent the downward moving gas from entering the air plena 44 and the associated flow channel 28.

It should be appreciated that the lower distribution section 58, would also be fitted with corresponding air and gas duct manifolds (not shown).

As shown in FIG. 4, a given flow plenum such as 45, feeds the flow channels 28*a*, 28*b*, of two adjacent heat exchanger modules, 16*a*, 16*b*. In effect, the right side channels 28*a* of module 16*a* and the left most channels 28*b* of module 16*b*, form a bifurcated flow conduit 60, in this instance carrying gas downwardly. The folded plate heat exchanger surfaces in FIG. 4 are evident on either side of the section crosshatching shown at 18*a*, 18*b*. In FIG. 4, the downward gas flow in on the side of the folded plates 18*a*, 18*b* facing the observer, whereas the upward air flow in bifurcated conduit 62, through which air moves upwardly through the folds of the folded plates 18, on the surfaces opposite the observer, as indicated by the dashed flow line arrows. It can be appreciated that the modules 16*a*, 16*b* alternate from front to back of the heat exchanger unit 10, and that the modules thus form alternating flow conduits 60, 62.

Figure 5:
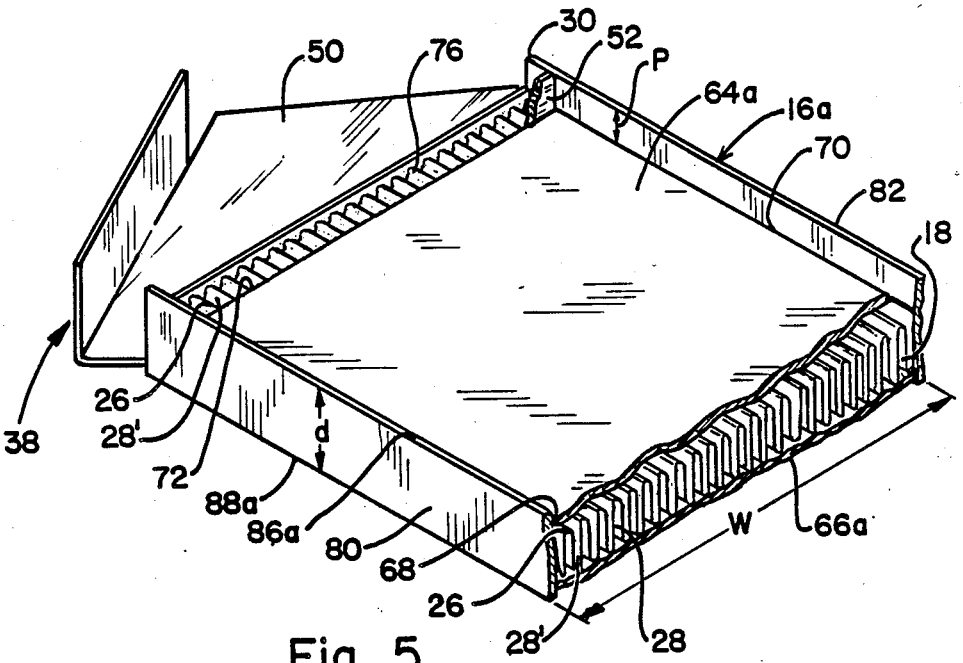
FIG. 5 is a perspective view of a folded plate heat exchanger module with the preferred baffle plate, in accordance with one aspect of the invention.

As shown in FIGS. 4, 5, and 9 each heat exchanger module such as 16*a* preferably includes a pair of flat, substantially rectangular flow plates 64*a*, 66*a* located on the front and back ridges 26, respectively, and having opposed side edges spanning the side edges of the folded plate 18 and having opposed longitudinal edges 72, 74 that are closer together than the longitudinal edges 76, 78 of the folded plate. Preferably, a pair of opposed side plates 80*a*, 82*a* are sealingly attached at right angles to the side edges 68, 70 of the flow plates 64, 66 and longitudinally span the side edges of the sheet 18. The side plates 80, 82 have a depth d in the front to back direction of the sheet which exceeds the distance between the flow plates 64, 66 so that each side plate projects a predetermined distance p perpendicularly to each flow plate. Each flow plate 64 is sealingly attached at its side edges 68, 70 to a respective side plate 80, 82 and each folded sheet 18 is sealingly attached, e.g., welded, along its side edges 84 to at least one of a respective side plate and a respective flow plate. As mentioned above, a blank off plate 52 is sealingly engaged to one of the flow plates 64 and the portions of the side plates projecting from the flow plates, for blanking off the upper and lower exposed portions of the sheet 18 from each other.

This arrangement of the flow plates 64, 66 relative to the side plates 80, 82 and the folded sheet 18, cooperates with the concave portions 24 of the respective folds, to define the longitudinal flow channels 28 between the folded sheet and an adjacent flow plate. In essence, each flow plate 64 directs a gas or air flow along the flow channels 28 of a sheet in a longitudinal direction, either upwardly or downwardly, between plena 44, or 45 at the longitudinal ends of each heat exchanger module 16.

Preferrably, the side plates 80, 82 of each module 16 are flush with, for example, the back flow plate 66 and project only from, for example, the front flow plate 64. The blank off plate 52 similarly projects from the flow plate 64 to the same extent p as the projection of the side plates 80, 82.

In accordance with one feature of the present invention, the active section 20 of the packaged heat exchanger 10 shown in FIG. 1 is constructed by welding or otherwise joining together individual heat exchanger modules 16 of the type shown in FIGS. 5 and 9. The front edges 86*a* of the side plates, of module 16*a* are joined to the back edges 88*b* of the side plates on the module 16*b* nested in front of the first module. A plurality of such modules are nested together and joined sequentially, to form the active section of the unit. In this arrangement, the side plates 80, 82 serve as structural members for their respective modules, and also serve as structural support and outer housing, for the unit 10 as a whole. The modules 16 may be shop connected into convenient size shipping components, or assembled as completed heat exchanger packages 10 if shipping clearances permit, thus minimizing final assembly at the job site. All modules are structurally complete and self supporting so the interconnecting attachments are primarily for sealing rather than a structural.

Figure 6:
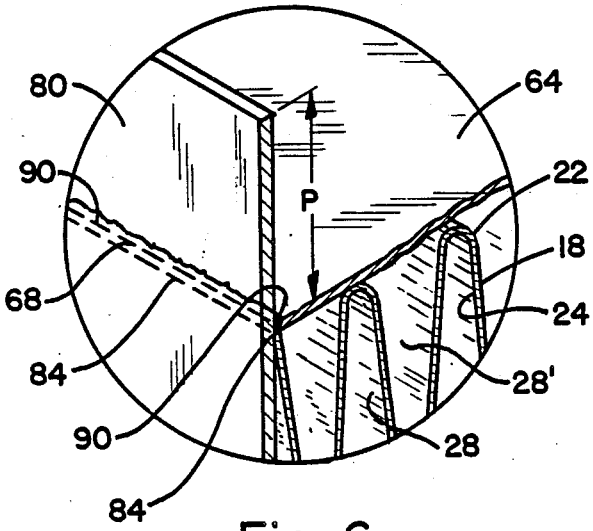
FIG. 6 is an enlarged detail view of the connection between the heat transfer surface and related support structure in the lower corner of the module illustrated in FIG. 5.

As shown in the enlarged, detailed view of FIG. 6, it is preferable that the side edges 84 of the folded sheet 18 or heat transfer surface, extend into the weld area 90 between the side edges 64 of the flow plate and the side plates 80. In this manner, a single longitudinal weld structurally and sealingly joins three related members or components of the module. This results in good air to gas sealing at these points during operation of the unit. Furthermore, this modular construction permits access to all inside welds so that spacing is not affected by requirements for manual access to areas between modules and all interconnecting attachments are accessible from the exterior of the unit.

With each of the modules being identical (except for the baffle orientation), fabrication of the modules and assembly thereof in the field, is considerably simplified relative to conventional heat exchanger systems.

It should be appreciated that the front 28' and rear channels 28 on a given heat exchanger module 16 must be fluidly separated from each other. One such barrier is in the form of a closure 92 at both longitudinal ends 76, 78 of each folded sheet 18. Thus, the air or gas flows into or out of the channels 28', 28 from the respective plena 44, 45 and through the exposed portions of the channels at the upper and lower edges 72, 74 of the flow plates 64, 66 or blank off plate 52, rather than through the longitudinal ends of the sheets 18.

Figure 7:
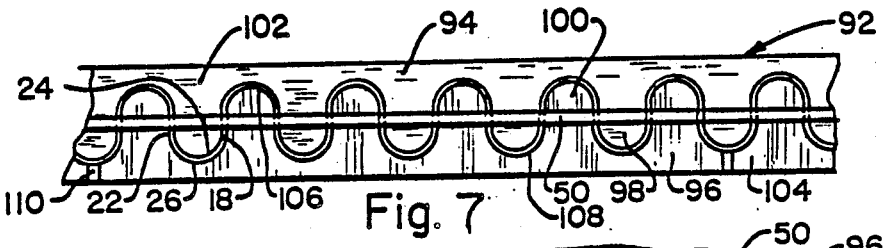
FIG. 7 is a top view of the preferred manner of sealing the longitudinal ends of each folded plate heat exchanger module, including the connection of a baffle plate.
Figure 8:
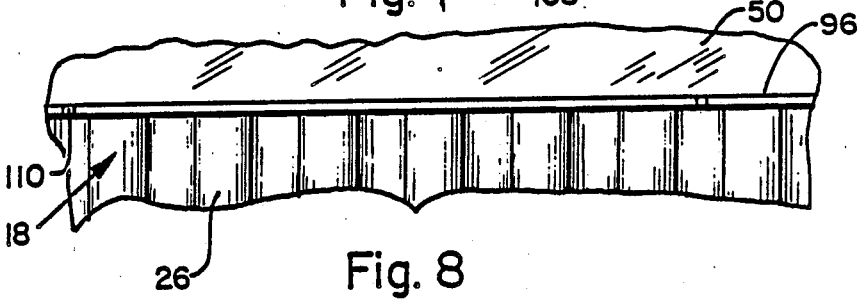
FIG. 8 is a partial side view of the longitudinal end of the sealed heat exchanger module shown in FIG. 7.

FIGS. 7 and 8 show another feature of the present invention, for simply and effectively sealing the ends of each folded sheet 18. According to this aspect of the invention, the closure 92 includes two closure bars 94, 96 having finger-like members 98, 100 interposed between the undulations in the sheet 18. The finger members are in interference engagement with the channels at the longitudinal edges 76, 78 of the sheet 18, for closing the longitudinal ends of the channels 28. Each bar 94, 96 has a base portion 102, 104 and a plurality of substantially sinusoidal concave 106 and convex 108 contours mating in interference engagement with the sinusoidal contours 22, 24 of the ridges 26 and channels 28.

The closure bars 94, 96 are installed in pairs, by inserting a first closure bar 94 perpendicularly to the ridges 26 on one surface of the sheet 18 until the convex 108 and concave 106 projections of the bar mate with the concave 24 and convex 22 surfaces on the one surface, respectively, then inserting a second closure 96 bar perpendicularly to the ridges of the other surface of the sheet until the convex and concave projections mate with the concave and convex surfaces respectively of the other surface. The folded sheet 18 preferably extends into the closure bars 94, 96, so that by pressing the closure bars toward each other, a tight interference engagement between the bar projections and the sheet front and back surfaces is achieved. The closure bars 94, 96 are then secured to each other to maintain the tightly packed, interference engagement between each bar and the side of the sheet 18 with which it is in contact.

As shown in FIGS. 7 and 8, the base portions 102, 104 of each closure bar 94, 96 can include a slit 110, thereby facilitating manufacture of the closure bars since each bar 94, 96 may be made identical and may be cut from a single full width piece with no scrap. By staggering the slit 110, structural integrity is maintained and minor length variation can be accommodated.

In accordance with another feature of the present invention, the joining of the closure bars 94, 96 at a given end of the folded sheet 18, is accomplished by positioning a plate member perpendicularly in contact with both closure bars and substantially centered therebetween, and welding the plate member to each of the closure bars. Preferably, this plate is a vertical wall 50 of one the baffle plates 38 of the type to be described more fully below, as illustrated in FIG. 5.

This arrangement of the end sealing of the folded sheet heat transfer surface solves a longstanding problem arising from the complex configuration of the sheet 18 in the region to be sealed. In accordance with the preferred embodiment, not only is a good interference fit seal achieved, but a lasting, rigid arrangement is formed among the two closure bars 94, 96 and the associated wall 50 of baffle plate 38. Thus, as will be described more fully below, the desirable characteristics of a modular system are maintained, because the baffle plates 38 can be nested together and attached in a similar manner and at substantially the same time that the side plates 86, 88 of each module 16 are welded together.

This closure arrangement is shown in the packaged heat exchanger unit as viewed in FIG. 4. The distribution section 34 includes a plurality of side by side wall portions 50 which form the separator plate welded between the closure bars 92. It should be appreciated that a similar arrangement exists at the lower distribution section (not shown). In an additional feature of the invention, a plurality of folded sheets may be stacked vertically, i.e., in the direction of flow as shown in FIG. 4. This can be accomplished by having a modified separator plate 162 joined at its upper and lower ends to respective closure bars 164, 166, in a fashion analoqous to that shown in FIGS. 7 and 8. These plates and closure bars separate and direct air and gas flow as indicated by the arrows 168, 170. This type of arrangement permits using different materials to compensate for variable requirements of temperature, corrosion, or desired heat transfer coefficients, at different elevations within a single heat exchanger unit. Preferably, a sealing ring 172 is connected between the spaced apart front or rear plates of the vertically spaced apart upper and lower modules, to permit flow in the direction of arrows 168 and 170 between the upper and vertically aligned lower folded sheets, while isolating this flow from the external environment. Preferably, the outer dimension of the seal ring is no greater than the outer dimension of the distribution section 34.

FIG. 9 is a portion of the unit 10 showing details of the distribution section 34, in perspective. The connection of a baffled plate wall 48 of module **16*b* to the closure bars, and the nested relationship of several baffle plates to define individual distribution chambers 46, part of which are open 40 and part of which are blocked by flap structure 42**.

FIGS. 10 through 14, illustrate another feature of the invention, wherein a single baffle plate perform 12 is foldable into one of two formed baffle members **114*a*, 114*b*, which are nested alternately to form the distribution sections 116, 118 having distribution channels, at each end of the active section 120 of the unit 122. Each baffle plate or member 114 has a planar wall 124 with front and back surfaces 126, 128 and a substantially straight horizontal base edge 130. Two opposed, side edges 132, 134, in the plane of the wall portion 124, are angled toward each other symmetrically about an imaginary centerline projecting in the plane of the wall portion perpendicularly from the mid point of the base edge 130. A flap portion 134 is integrally formed along one of the side edges, in the plane of the wall portion 124 in the perform 112**.

Figure 11:
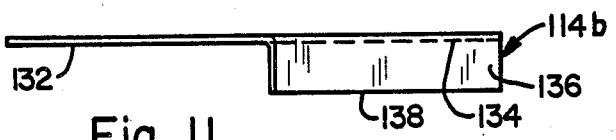
FIG. 11 is a top view of the baffle plate shown in FIG. 10, after forming.
Figure 12:
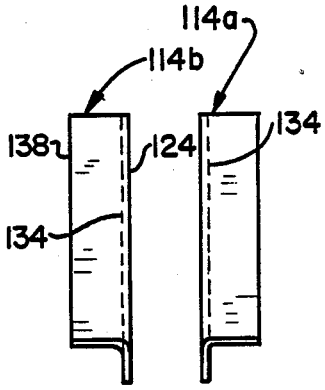
FIGS. 12 (*a*) and (*b*) show the end views of the formed baffle plates of FIG. 10, corresponding to left-handed and right-handed folding, respectively.

Prior to assembly as a flow distribution section, one half of the plates 112 are formed with a left hand bend (FIGS. 5 and **12*b*) in the flap portion, and the other half are formed with a right hand bend (FIGS. 9 and 12*a*) in the flap portion. The resulting formed views are shown in FIGS. 11 and 12. The bent flap 136 portion is sloped and forms a divider plate projecting in the depth direction a distance d relative to the plate wall portion 126. The divider plate or flap has a projecting edge 138 which is parallel to the wall portion 124**.

Figure 10:
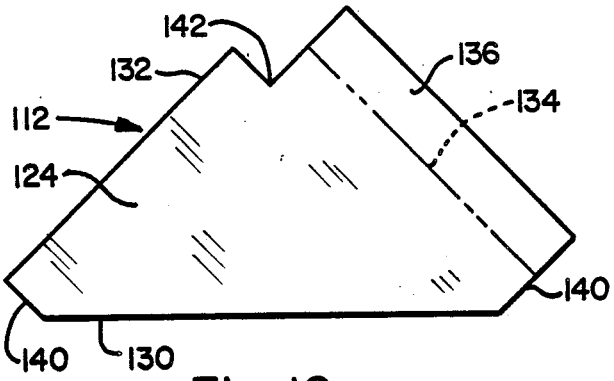
FIG. 10 is a plan view of an outstretched baffle plate perform, prior to folding and assembly.
Figure 13:
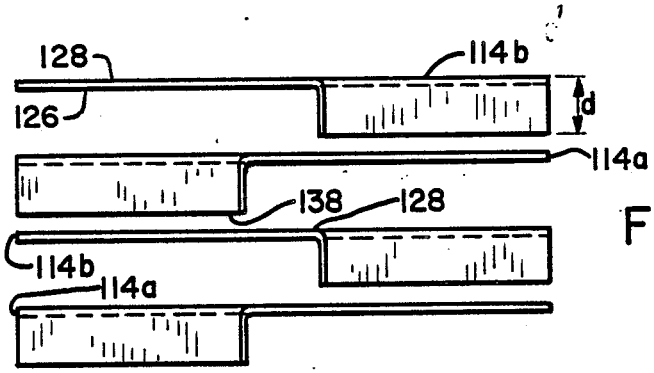
FIG. 13 is a top view of the left and right hand folded baffles of FIG. 12, showing how the formed baffle plates are alternately positioned relative to one another when nested.

FIG. 13 illustrates how the formed baffle plates **114*a*, 114*b* are nested together. It should be appreciated that a separation is shown between adjacent baffle plates for purposes of clarity, whereas during assembly of the unit, the baffle plates will be brought into contact with each other. Thus, a first and third right hand baffle plates 114*a* are alternated with second and fourth, left hand baffle plates 114*b*, as shown in FIG. 13. The projecting edges 138 of each divider plate or flap portion 136 establish line contact with a rear wall portion 128 of an adjacent baffle plate forming, a seal therebetween, such that, for each flap portion, air or gas impinging on the top of the flap is isolated relative to air or gas impinging on the bottom of the flap. With reference to FIG. 9, the flaps 42*a* and 42*b* correspond to baffle plates 114*a* and 114*b*, respectively in FIG. 13. As shown in FIGS. 9 and 10, each baffle plate is, when formed, substantially triangular, except that preferably, each corner of the triangle is notched as shown at 140, 142**.

Figure 14:
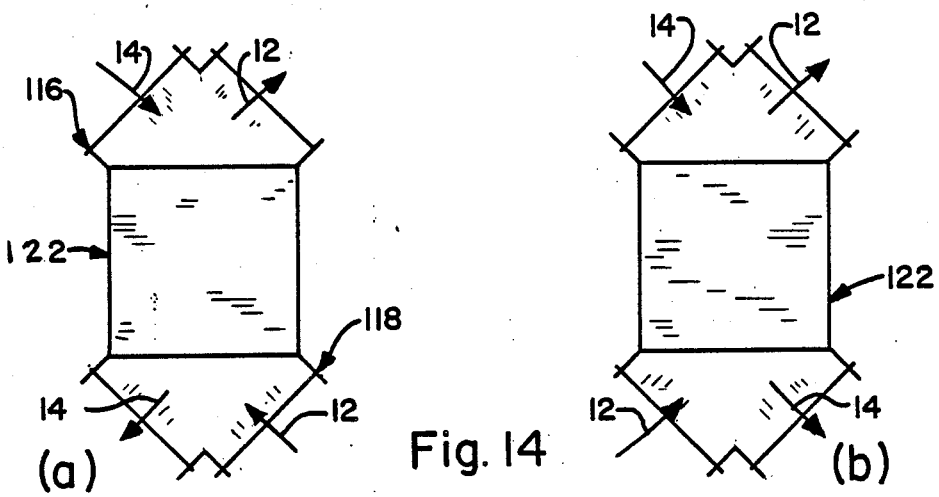
FIGS. 14 (*a*) and (*b*) are schematic front elevation views of a packaged heat exchanger in which the upper and lower distribution sections have been formed utilizing the baffle plates as shown in FIGS. 10–13.

FIG. 14 is a schematic illustration of how the distribution sections 116, 118 formed using the baffle plates described above, can be utilized with the active section 122 of the heat exchanger unit 122. In FIG. 14(*a*) which is similar to FIG. 1, the gas 14 enters and leaves the unit on the left, whereas the air 12 enters and leaves the unit on the right. In FIG. 14(*b*) the gas 14 enters on the left and is discharged on the right, whereas the air 12 enters on the left and is discharged from the right. The simplicity and modularity of the baffle plates in accordance with this feature of the invention, permits rapid field installation, particularly when employed with the folded sheet heat exchanger modules described hereinabove, and affords flexibility to accommodate a variety of orientations and flow rates in the air and gas connections to the overall process.

Figure 17:
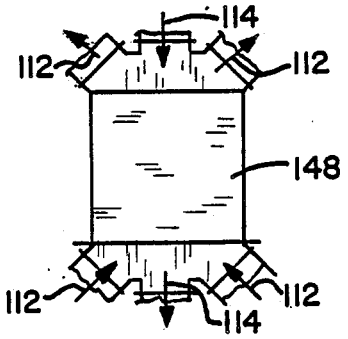
FIG. 17 shows upper and lower flow distribution sections for a packaged heat exchanger, in which a total of six flow paths are provided.
Figure 15:
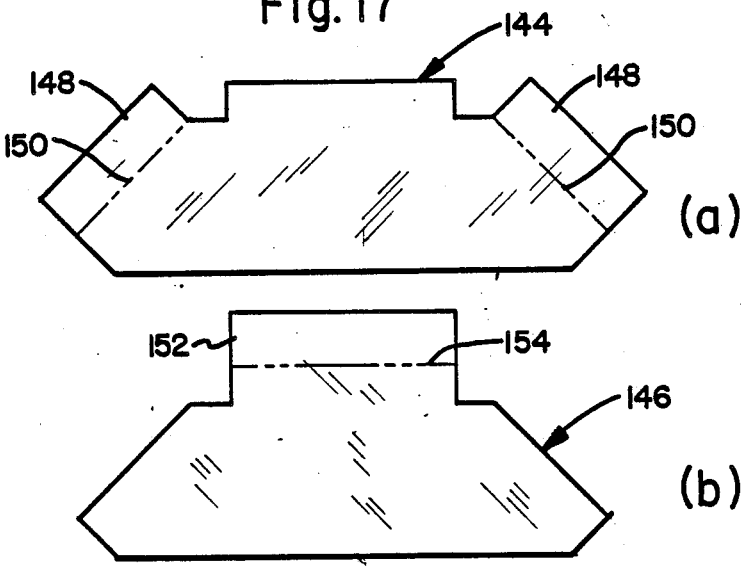
FIGS. 15 (*a*) and (*b*) show a variation of the baffle plate shown in FIG. 10, in which three flow paths can be formed by nesting two types of baffle plates alternatively.
Figure 16:
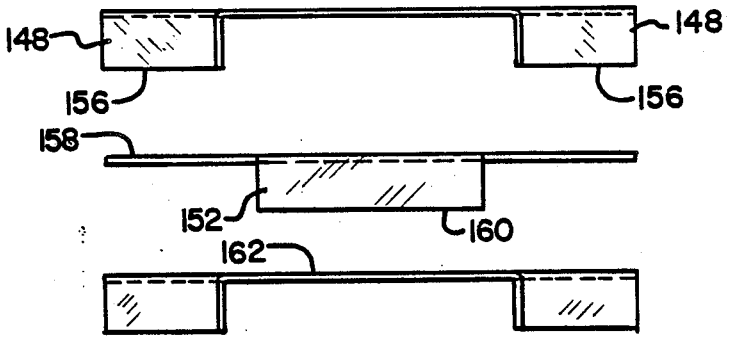
FIG. 16 shows how the baffle plates of FIGS. 15 (*a*) and (*b*) are alternately positioned when nested together.

FIGS. 15–17 show a variation of the embodiment of the invention shown in FIGS. 10–14, in which, for example, two air and one gas distribution channels can be formed with each pair of nested baffle plates 144, 146. When the plates are nested as shown in FIG. 16, and the resulting distribution sections are associated with an active section 148, the ducting and cross flow patterns as shown in FIG. 17 can be achieved.

In FIG. 15, the first, or preformed larger baffle 144 has flap 148 portions which, when bent, project only from the left and right sloped side edges 150 in the same direction. The smaller type of baffle plate 146 has a substantially rectangular flap 152 projecting only from the top edge 154 parallel to and planar with the top edge, and, when bent, projecting in the same direction and the same distance as the projection of the side flaps 148 of the larger type baffle plate 144. The larger and smaller baffle plates are alternatively nested such that the projecting edges 156 of the side flaps of the larger type rest against the rear of the wall portion 158 of the smaller type 146, and the projecting edge 160 of the flap 152 on the smaller type rests against the rear of the wall portion 162 of the larger type 144.

It should be appreciated that the preferred embodiment of applicant's invention incorporates all of the novel features described above, but that all novel features need not be utilized together.

The heat exchanger and its various features are readily adaptable to a number of configurations. The heat exchanger is designed for parallel flow of fluids in either counter flow or uniform directional flow as applications dictate. This flow orientation provides substantially a flat temperature profile across the outlet ducts as compared to the skewed-temperature profile typical of a cross-flow heat exchanger or to a lesser degree typical of a rotary-type heat exchanger. Counter flow optimizes the the efficiency, making it superior to any cross-flow design.

The flat temperature profile allows design of the unit to a specific temperature level such as the acid dew point or water dew point, without risk of cold spots either creating corrosion problems or dictating a higher temperature design level. The constant temperature profile also negates any need for flow mixing or long duct runs to even out temperatures where required by downstream equipment such as bag filters. The modularity of the unit and the simplicity of the distribution chamber and flow plena achieve high volumetric efficiency. This permits a far more compact unit than others of this general category.

An infinite range of flow volume can be accommodated by merely increasing or decreasing the number of rows of baffle plate modules, and the heat exchangers may be operated in parallel or series as required.

We claim:

1. A folded plate heat exchanger module comprising:

a folded sheet of heat conductive material having opposed longitudinal edges and opposed side edges, the folds defining on the front and back of the sheet a plurality of parallel longitudinal ridges and parallel longitudinal channels between the ridges;

a pair of flat, substantially rectangular flow plates located on the front and back ridges, respectively, and having opposed side edges spanning the side edges of the folded sheet and having opposed longitudinal edges that are closer together than the longitudinal edges of the sheet, thereby exposing longitudinally upper and lower portions of the sheet;

a pair of opposed side plates sealingly attached at right angles to the side edges of the flow plates and longitudinally spanning the side edges of the sheet, the side plates having a depth in the front to back direction of the sheet which exceeds the distance between the flow plates so that each side plate projects a predetermined distance from at least one flow plate;

each flow plate being sealingly attached at its side edges to a respective side plate and each folded sheet being sealingly attached along its side edges to at least one of a respective side plate and a respective flow plate; and means sealingly engaging one of the flow plates and the portions of the side plates projecting from the flow plates, for blanking off said upper and lower exposed portions of the sheet from each other except for flow through said channels.

2. The heat exchanger module of claim 1, wherein the side plates project from only one flow plate, and the means for blanking project relative to the same flow plate.

3. The heat exchanger module of claim 1, wherein the means for blanking comprises a plate spanning the flow plate at one longitudinal edge thereof.

4. The heat exchanger module of claim 1, wherein the side edges of the sheet and the side edges of the flow plate contact the side plates and are welded together and to the side plates.

5. The heat exchanger module of claim 1, further including means in interference engagement with the channels near the longitudinal edges of the sheet, for closing the longitudinal ends of the channels.

6. The heat exchanger module of claim 5, further including a baffle plate welded to and extending perpendicularly from the means for closing the channels.

7. The heat exchanger module of claim 5 wherein said means for closing the channels includes a pair of closure bars, each bar having a base portion and a plurality of substantially sinusoidal concave and convex contours mating in interference engagement with ridges and channels, whereby the longitudinal ends of the channels are blocked.

8. The heat exchanger module of claim 1, wherein said module is joined in front-to-back relation to a substantially identical second module along a longitudinally extending edge of each of the side plates of both modules.

9. The heat exchanger module of claim 3, wherein said module is joined to a substantially identical second module along a longitudinally extending edge of each of the side plates of both modules and wherein said means for blanking is joined to a longitudinal edge of a flow plate on the second module.

10. A packaged folded plate heat exchanger unit comprising:

at least two modular heat exchangers joined together in front-to-back relation, each heat exchanger module including a folded sheet of heat conductive material having opposed longitudinal edges and opposed side edges, the folds defining on the front and back of the sheet a plurality of parallel longitudinal ridges and parallel longitudinal channels between the ridges;

a pair of flat, substantially rectangular flow plates located on the front and back ridges, respectively, the flow plates having opposed side edges spanning the side edges of the folded sheet and having opposed longitudinal edges that are closer together than the longitudinal edges of the sheet, thereby exposing longitudinally upper and lower portions of the sheet;

a pair of opposed side plates sealingly attached at right angles to the side edges of the flow plates and longitudinally spanning the side edges of the sheet, the side plates having a depth in the front-to-back direction of the sheet which exceeds the distance between the flow plates so that each side plate projects a predetermined distance from the front flow plate;

each flow plate being sealingly attached at its side edges to a respective side plate, each folded sheet being sealingly attached along its side edges to at least one of a respective side plate and a respective flow plate and the front longitudinal edges of the side plates of the first module being joined to the back longitudinal edges of the side plates of the second module, thereby defining a three dimensional plenum space between the first and second modules;

means sealingly engaging the front flow plate of the first module, the side plate projections, and the back flow plate of the second module, for blanking off said upper exposed portions of the sheets from the lower exposed portion of the sheets except for flow through said channels on the first and second modules, thereby defining respective upper and lower flow plena between the first and second modules.

11. The packaged heat exchanger unit of claim 10, further including means in interference engagement with the channels near the longitudinal edges of the sheet, for closing the longitudinal ends of the channels.

12. The packaged heat exchanger unit of claim 11, further including a baffle plate welded to and extending longitudinally from the means for closing the channels.

13. The packaged heat exchanger unit of claim 11, wherein each of the modular heat exchangers comprises at least two vertically stacked folded sheets, the stacked folded sheets having means for closing the respective longitudinal ends of the channels, said unit further including a baffle plate vertically connected between said means for closing the respective channel ends.

14. A packaged folded heat exchanger unit comprising:

at least four modular heat exchangers joined together in front-to-back relation, each heat exchanger including a folded sheet of heat conductive material having opposed longitudinal edges and opposed side edges, the folds defining on the front and back of the sheet a plurality of parallel longitudinal ridges and parallel longitudinal channels between the ridges;

a pair of flat, substantially rectangular flow plates located on the front and back ridges, respectively of each sheet, and having opposed side edges spanning the side edges of each respective sheet and having opposed longitudinal edges that are closer together than the longitudinal edges of each respective sheet, thereby exposing longitudinally upper and lower portions of the sheets;

a pair of opposed side plates sealingly attached at right angles to the side edges of each flow plate and longitudinally spanning the side edges of each respective sheet;

each flow plate being sealingly attached at its side edges to a respective side plate and each folded sheet being sealingly attached along its side edges to at least one of a respective side plate and a respective flow plate;

a first plate sealingly engaging the front flow plate of the first module and the back flow plate of the second module, a second plate sealingly engaging the front flow plate of the second module and the back flow plate of a third module, and a third plate sealingly engaging the front flow plate of the third module and the back of the flow plate of the fourth module, thereby defining first, second, and third upper plena and first, second, and third lower plena between the front flow plate of the first module and the back flow plate of the second module, the front flow plate of the second module and the back flow plate of the third module and the front flow plate of the third module and the back flow plate of the fourth module, respectively;

means for closing the longitudinal ends of the channels in each heat exchanger;

first, second, and third upper baffle plates extending vertically from the respective means for closing the longitudinal ends of the channels of said, first, second, and third sheets, each of said baffles being of modular construction and nested together front-to-back to define a plurality of independent flow distribution chambers, each chamber fluidly connected to a respective one of said plena.

15. The folded plate heat exchanger unit of claim 14, wherein each of said baffle plates has a flat wall portion extending vertically parallel to the flow plate and at least one flap portion bent at an angle to the wall portion and in contact with the wall portion of an adjacent baffle plate.

16. The folded plate heat exchanger unit of claim 15, wherein each flap portion is integral with a respective baffle plate wall portion.

17. The folded plate heat exchanger unit of claim 15, wherein the wall portion of each baffle plate is in the form of a flat isosceles triangle and wherein each flap is formed at a bend lie coincident with one leg of the triangle.

18. The folded plate heat exchanger unit of claim 17, wherein each flap portion has a dimension which is parallel to and greater than the distance between the front and back flow plates on the modular heat exchangers.

19. The folded plate heat exchanger unit of claim 17 wherein the modular heat exchangers are joined together, the flow distribution chamber defined for each plenum includes an unobstructed opening and an angled closure, the closure being formed by one of said flap portions.

* * * * *